US008608452B2

(12) United States Patent
Draheim et al.

(10) Patent No.: US 8,608,452 B2
(45) Date of Patent: Dec. 17, 2013

(54) VARIABLE COOLANT PUMP

(75) Inventors: Alexander Draheim, Erlangen (DE); Andreas Nendel, Hessdorf (DE); Eduard Golovatai-Schmidt, Hemhofen (DE); Jens Schaefer, Herzogenaurach (DE); Sandra Schaefer, Hoechstadt (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 272 days.

(21) Appl. No.: 13/063,046

(22) PCT Filed: Aug. 10, 2009

(86) PCT No.: PCT/EP2009/060340

§ 371 (c)(1),
(2), (4) Date: Mar. 9, 2011

(87) PCT Pub. No.: WO2010/028921

PCT Pub. Date: Mar. 18, 2010

(65) Prior Publication Data

US 2011/0162597 A1 Jul. 7, 2011

(30) Foreign Application Priority Data

Sep. 9, 2008 (DE) ..... 10 2008 046 424

(51) Int. Cl.
*F04B 49/00* (2006.01)

(52) U.S. Cl.
USPC ..... 417/212; 417/362; 415/131; 415/49

(58) Field of Classification Search
USPC ..... 417/362, 212; 415/48, 49, 34, 126, 129, 415/131–132, 157–158; 123/41.44
See application file for complete search history.

(56) References Cited

U.S. PATENT DOCUMENTS 2,756,834 A * 7/1956 Dauben ..... 180/56
3,022,450 A * 2/1962 Chase, Jr. ..... 361/194

(Continued)

FOREIGN PATENT DOCUMENTS

| | | | |
|---|---|---|---|
| DE | 21 10 776 | A1 | 9/1972 |
| DE | 92 00 240 | U1 | 2/1992 |
| DE | 10 2005 004 315 | A1 | 8/2006 |
| FR | 587 131 | A | 4/1925 |

OTHER PUBLICATIONS

Office of Naval Research Departmen of the Navy, Arlington, Va. 22217, Technical Disclosure Bulletinn vol. XIV No. 2 Jun. 1989.

*Primary Examiner* — Devon Kramer
*Assistant Examiner* — Joseph Herrmann
(74) *Attorney, Agent, or Firm* — Lucas & Mercanti, LLP

(57) ABSTRACT

A variable coolant pump for a cooling circuit of an internal combustion engine that has a pump housing in which is mounted a hollow shaft that is driveable by a pulley. At one end of the hollow shaft an impeller is fastened which has vanes projecting into an inlet chamber and which is firmly connected via axial bridges to a cover disc. Through rotation of the impeller together with the cover disc, water can be sucked into the inlet chamber via an inlet connection piece of the pump housing and conveyed by the vanes into an annular passage of the pump housing. A guide disc with a contour corresponding to the impeller is further arranged between impeller and cover disc. The guide disc is guided by the axial bridges and can be displaced axially via a positioning unit by a piston located inside the hollow shaft.

7 Claims, 2 Drawing Sheets

(56) References Cited

U.S. PATENT DOCUMENTS 3,482,523 A * 12/1969 Morando ..... 415/27
5,041,748 A * 8/1991 Huber ..... 310/80
5,169,286 A * 12/1992 Yamada ..... 415/48
5,431,340 A * 7/1995 Schirpke et al. ..... 237/12.3 B
5,800,120 A 9/1998 Ramsay
6,040,752 A * 3/2000 Fisher ..... 335/234
6,074,167 A * 6/2000 Olifirov et al. ..... 415/131

* cited by examiner

VARIABLE COOLANT PUMP

This application is a 371 of PCT/EP2009/060340 filed Aug. 10, 2009, which in turn claims the priority of DE 10 2008 046 424.4 filed Sep. 9, 2008, the priority of both applications is hereby claimed and both applications are incorporated by reference herein.

FIELD OF THE INVENTION

The invention relates to a variable coolant pump for a cooling circuit of an internal combustion engine, comprising a pump housing in which is mounted a hollow shaft driveable by means of a pulley, at the one end of which hollow shaft is fastened an impeller which has vanes projecting into an inlet chamber and which is firmly connected via axial bridges to a cover disc, it being possible through rotation of the impeller together with the cover disc for water to be sucked into the inlet chamber via an inlet connection piece of the pump housing and to be conveyed by means of the vanes into an annular passage of the pump housing.

BACKGROUND OF THE INVENTION

In the field of internal combustion engines, water-cooled engines have been adopted very extensively. In such engines cooling water is pumped in a closed circuit with the aid of a coolant pump through cooling passages in the region of the cylinders in order to cool the internal combustion engine, and is then conveyed to an air/water radiator where the heated water is cooled down by means of the air stream generated by vehicle motion. In this case the pump needed to circulate the water is usually connected via a belt to a pulley of the crankshaft of the internal combustion engine.

The direct coupling between coolant pump and crankshaft ensures that the rotational speed of the pump is dependent on the rotational speed of the internal combustion engine. This has the result that in the high rotational speed range of the internal combustion engine a correspondingly large volume flow is made available by the pump, in an amount which is not required for cooling. By contrast, upon cold starting of the internal combustion engine the problem arises that coolant is already circulating through the cooling passages, which hinders the heating of the combustion chambers and therefore delays the attainment of an optimum operating temperature.

In view of these facts, in modern internal combustion engines use is frequently made of variable coolant pumps the delivery rate of which can be adjusted according to demand.

Known from DE 10 2005 004 315 B4 is a variable coolant pump in which an impeller and a cover disc are provided on a hollow shaft mounted in a pump housing in order to convey water aspirated via a pressure connection piece into an annular passage of the pump housing. In addition, a slide element located behind the impeller is mounted on the hollow shaft and is displaceable against a spring by means of an electromagnet in the direction of the impeller. In this case the slide element has in its outer region axially disposed projections which extend beyond the impeller and with which, upon displacement of the slide element in the direction of the impeller, the annular passage of the pump housing is closed and pumping of the cooling water by the coolant pump is therefore prevented.

A disadvantage of such an arrangement is that the system for regulating the coolant flow by means of the slide element involves a complex and costly mechanism and therefore a complicated structure. Moreover, as a result of the orientation of the projections of the slide element, strong turbulence is generated in the region of the annular passage of the pump housing when the pump is partially open.

It is therefore the object of the present invention to provide a variable coolant pump for a cooling circuit of an internal combustion engine which has a simple structure and which, even with partial delivery, tends to produce only vanishingly small turbulence.

SUMMARY OF THE INVENTION

This object is achieved on the basis of a variable coolant pump for a cooling circuit of an internal combustion engine, which comprises a pump housing in which is mounted a hollow shaft that is driveable by a pulley. At the one end, the hollow shaft is fastened an impeller which has vanes that project into an inlet chamber and which is firmly connected via axial bridges to a cover disc. Through rotation of the impeller together with the cover disc, water can be sucked into the inlet chamber via an inlet connection piece of the pump housing and conveyed by the vanes into an annular passage of the pump housing. A guide disc with a contour corresponding to the impeller is arranged between impeller and cover disc is guided by axial bridges connecting the impeller to the cover disc and the guide disc is axially displaceable via a positioning unit by a piston located inside the hollow shaft. Through the placing of a guide disc between impeller and cover disc, and through the axial displacement of the guide disc by a piston guided in the hollow shaft, the structure of the coolant pump according to the invention is kept simple. Furthermore, turbulence formation is reduced as a result of the contour of the guide disc corresponding to the impeller.

According to an embodiment, the guide disc has on its outer edge a projection oriented in the direction of the impeller with which it covers the annular passage of the pump housing as a function of the position between impeller and cover disc. This has the advantage that covering of the annular passage can be effected with simple means. Furthermore, because of its orientation, the projection does not contribute to turbulence formation even with a partially open pump.

In a development of the invention, the positioning unit is configured in the manner of an armature which is rigidly attached to the piston and is axially displaceable in a specified manner by means of a proportional magnet. By means of such an arrangement intermediate positions of the guide disc can also be effected, while a very compact configuration of the positioning unit is obtained at the same time.

According to an advantageous embodiment of the invention, the positioning unit is configured in the manner of a spindle which is in contact with the piston and is axially displaceable in a specified manner by means of an electric motor. Such a configuration of the positioning unit has the advantage that an axial displacement of the guide disc is possible even when subjected to relatively large forces, so that under some circumstances different configurations of the contours of the impeller and of the guide disc are also possible.

In a development of the invention, the guide disc is pretensioned towards the impeller via the piston by means of a return spring. Consequently, in the event of non-activation of the positioning unit the pump is maintained in an open position, ensuring circulation of cooling water in the event of failure of the positioning unit.

According to a further configuration of the invention, the hollow shaft is mounted by means of a double-row ball bearing. A reliable mounting of the hollow shaft with good load capacity is thereby achieved.

In a development of the invention, the pulley and the positioning unit are placed in a chamber located opposite the inlet connection piece, which chamber can be closed by means of a sheet metal element. This has the advantage that the placing of the pulley and of the positioning unit is considerably simplified during assembly. In addition, simple replacement of the positioning unit is possible if required.

The sheet metal element advantageously carries the positioning unit. An additional fastening of the positioning unit in the pump housing can thereby be dispensed with.

Further measures improving the invention are described in more detail below together with the description of a preferred exemplary embodiment of the invention, with reference to the figures.

DETAILED DESCRIPTION OF THE DRAWINGS

Figure 1A:
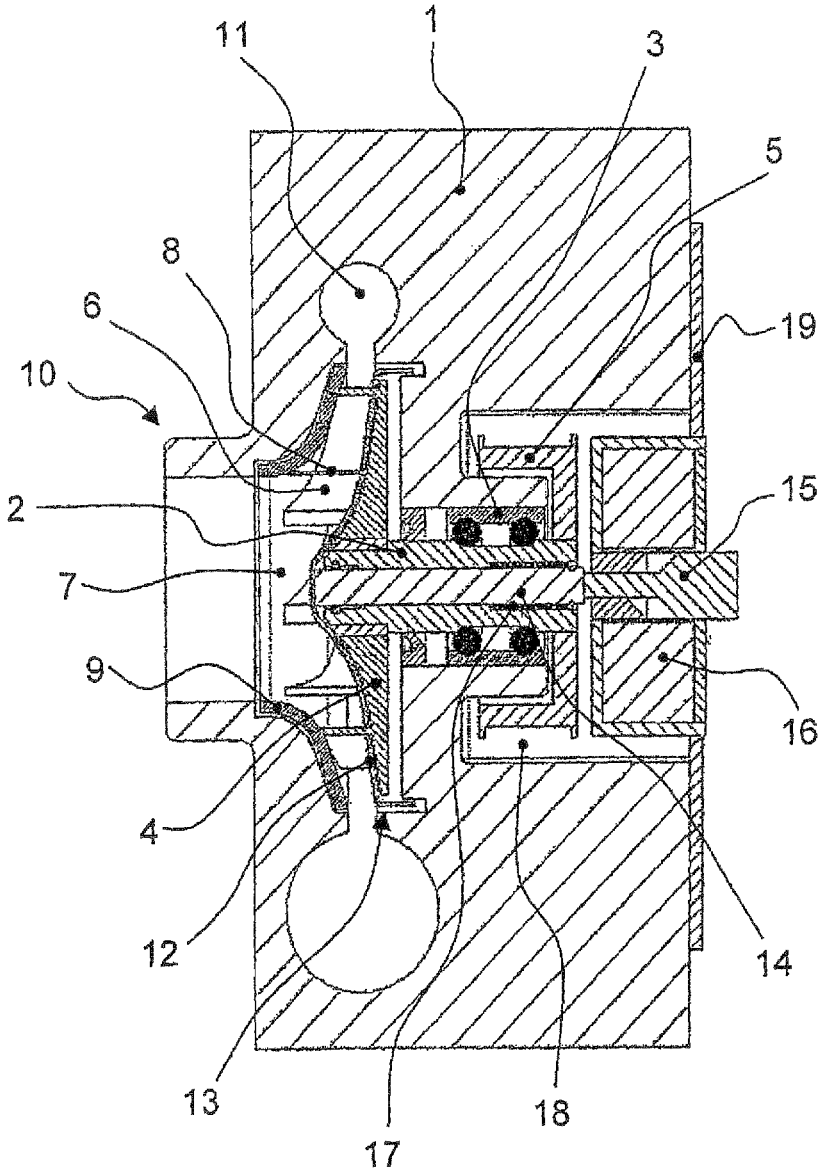
FIG. 1*a* is a sectional view of the variable coolant pump according to the invention with full pumping throughput.

FIG. 1*a* shows a sectional view of the coolant pump according to the invention, which has a hollow shaft 2 mounted in a pump housing 1. This hollow shaft 2 is mounted rotatably via a double-row ball bearing 3 in a bore of the pump housing 1 and carries an impeller 4 on its one end while it is connected rigidly to a pulley 5 at its other end. The hollow shaft 2 is driveable via this pulley 5 by means of a belt drive (not shown here) of the internal combustion engine. The impeller 4 has vanes 6 which extend axially into an inlet chamber 7 of the coolant pump. The impeller 4 is further connected via axial bridges 8 to a cover disc 9. During operation of the coolant pump water is drawn into the inlet chamber 7 via an inlet connection piece 10 of the pump housing 1 through rotation of the impeller 4 together with the cover disc 9 and, as a result of the centrifugal forces generated by the impeller 4 and further intensified by the vanes 6, is forced into an annular passage 11 of the pump housing 1 which, in its continuation, is connected to cooling passages (not shown here) of a cylinder head of the internal combustion engine.

In order to regulate the volume flow of the coolant pump, a guide disc 12, which has a contour corresponding to the impeller 4 and is guided displaceably by means of the axial bridges 8, is provided between impeller 4 and cover disc 9. This guide disc 12 further has on its outer edge a projection 13 with which, depending on the position between impeller 4 and cover disc 9, it covers the annular passage 11 of the pump housing 1. This projection 13 is oriented in the direction of the impeller 4. In addition, the guide disc 12 is connected rigidly at the centre of its inner side to a piston 14 which is guided displaceably in the hollow shaft 2. The piston 14 is further in contact, at its end opposite the guide disc 12, with an armature 15, a thickened end of which is positioned inside a proportional magnet 16.

Figure 1B:
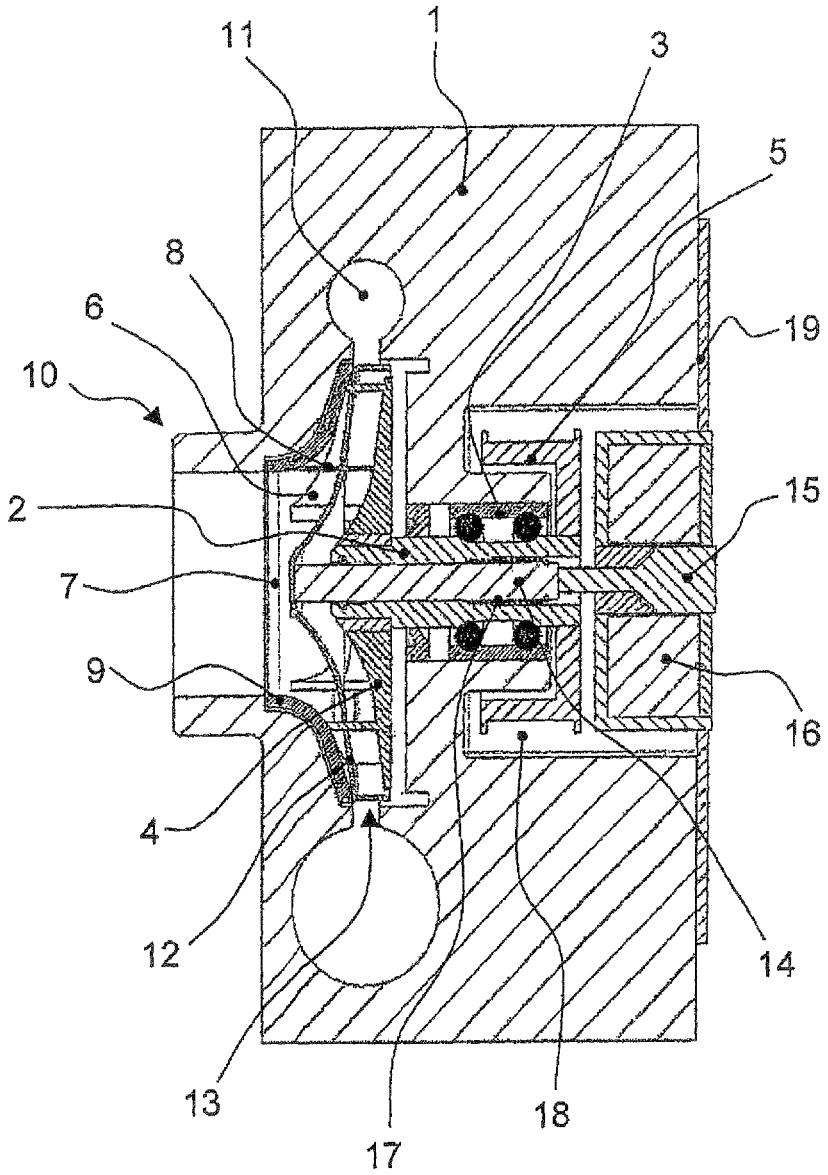
FIG. 1*b* is a sectional view of the variable coolant pump according to the invention with zero delivery.

Through activation of the proportional magnet 16, the armature 15 is displaced in the direction of the inlet chamber 7 of the coolant pump, causing a specified axial displacement of the guide disc 12 through contact with the piston 14. Moreover, through specified activations of the proportional magnet 16, intermediate positions of the guide disc 12 between impeller 4 and cover disc 9 can be adopted. In this connection, the fully open position of the guide disc 12 is shown in FIG. 1*a*. In contrast, a fully closed position of the coolant pump can be seen in FIG. 1*b*, in which position the annular passage 11 of the pump housing 1 is completely closed by means of the projections 13 of the guide disc 12. In this case, accordingly, no coolant is delivered to the cooling passages of the cylinder head. In order also to ensure delivery of cooling water to the full extent in the event of non-activation by the proportional magnet 16, or failure thereof, the guide disc 12 is indirectly pretensioned towards the impeller 4 via the piston 14 and a return spring 17.

In addition, to simplify installation of the pulley 5 and the proportional magnet 16, the pump housing 1 has at an end opposite the inlet chamber 7 a chamber 18 in which the pulley 5 and the proportional magnet 16 are placed and which is then closed by a sheet metal element 19. In this case the sheet metal element 19 at the same time carries the proportional magnet 16 and guides the armature 15.

The present invention is not restricted to the exemplary embodiment described hereinbefore. Rather, further variants are possible for axially displacing the piston 14 together with the guide disc 12, such as a pressure cell, hydraulic or pneumatic proportional valves, electric motors with spindle drive, etc.

LIST OF REFERENCES

1 Pump housing
2 Hollow shaft
3 Double-row ball bearing
4 Impeller
5 Pulley
6 Vane
7 Inlet chamber
8 Axial bridges
9 Cover plate
10 Inlet connection piece
11 Annular passage
12 Guide disc
13 Projection
14 Piston
15 Armature
16 Proportional magnet
17 Return spring
18 Chamber
19 Sheet metal element

The invention claimed is:

1. A variable coolant pump for a cooling circuit of an internal combustion engine, comprising:

a pump housing having an inlet connection piece and an annular passage;

a hollow shaft mounted in the pump housing;

a pulley arranged to drive the hollow shaft;

an inlet chamber;

an impeller fastened to one end of the hollow shaft and having vanes that project into the inlet chamber;

a cover disc;

axial bridges that firmly connect the impeller to the cover disc, whereby through rotation of the impeller, together with the cover disc, water can be sucked into the inlet chamber via the inlet connection piece of the pump housing and conveyed by the vanes into the annular passage of the pump housing;

a piston located inside the hollow shaft;

a positioning unit; and a guide disc having a contour corresponding to the impeller, arranged between the impeller and the cover disc, guided by the axial bridges, and displaceable axially via the positioning unit by the piston, a pulley arranged to drive the hollow shaft;

wherein the housing has a chamber located opposite the inlet connection piece, and further comprising a sheet metal element, wherein the pulley and the positioning unit are arranged in the chamber which is closeable by the sheet metal element and wherein the sheet metal element carries the positioning unit.

2. The variable coolant pump according to claim 1, wherein the guide disc has an outer edge with a projection oriented in a direction of the impeller, the guide disc covering the annular passage of the pump housing with the projection as a function of a position between the impeller and the cover disc.

3. The variable coolant pump according to claim 1, further comprising a proportional magnet, wherein the unit is an armature rigidly connected to the piston and displaceable axially in a specified manner by the proportional magnet.

4. The variable coolant pump according to claim 1, further comprising an electric motor, wherein the unit is a spindle in contact with the piston and displaceable axially in a specified manner by the electric motor.

5. The variable coolant pump according to claim 1, further comprising a return spring, arranged to pretension the guide disc towards the impeller via the piston.

6. The variable coolant pump according to claim 1, further comprising a double-row ball bearing arranged to mount the hollow shaft in the pump housing.

7. An internal combustion engine for driving a motor vehicle, including a variable coolant pump comprising: a pump housing having an inlet connection piece and an annular passage; a hollow shaft mounted in the pump housing; a pulley arranged to drive the hollow shaft; an inlet chamber; an impeller fastened to one end of the hollow shaft and having vanes that project into the net chamber; a cover disc; axial bridges that firmly connect the impeller to the cover disc, whereby through rotation of the impeller, together with the cover disc, water can be sucked into the net chamber via the inlet connection piece of the pump housing and conveyed by the vanes into the annular passage of the pump housing; a piston located inside the hollow shaft; a positioning unit; and a guide disc having a contour corresponding to the impeller, arranged between the impeller and the cover disc, guided by the axial bridges, and displaceable axially via the positioning unit by the piston, wherein the housing has a chamber located opposite the inlet connection piece, and further comprising a sheet metal element, wherein the pulley and the positioning unit are arranged in the chamber which is closeable by the sheet metal element, and wherein the sheet metal element carries the positioning unit.

* * * * *

UNITED STATES PATENT AND TRADEMARK OFFICE

CERTIFICATE OF CORRECTION

PATENT NO. : 8,608,452 B2
APPLICATION NO. : 13/063046
DATED : December 17, 2013
INVENTOR(S) : Draheim et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 273 days.

Signed and Sealed this
Twenty-second Day of September, 2015

Michelle K. Lee

Michelle K. Lee
*Director of the United States Patent and Trademark Office*